US005794536A

United States Patent [19]

Daugherty, Jr. et al.

[11] Patent Number: 5,794,536

[45] Date of Patent: Aug. 18, 1998

[54] END DESIGN FOR A RAILWAY TYPE FREIGHT CAR

[75] Inventors: David W. Daugherty, Jr., Plainfield; Staffan G. Brandt, Wauconda, both of Ill.

[73] Assignee: Westinghouse Air Brake Company, Wilmerding, Pa.

[21] Appl. No.: 670,778

[22] Filed: Jun. 20, 1996

[51] Int. Cl.[6] ..... B61D 49/00

[52] U.S. Cl. ..... 105/3; 105/1.4; 105/404; 105/410

[58] Field of Search ..... 105/1.4, 3, 4.1, 105/4.2, 8.1, 165, 167, 329.1, 410, 404

[56] References Cited

U.S. PATENT DOCUMENTS

| | | | |
|---|---|---|---|
| 1,039,585 | 9/1912 | Pascal | 105/3 |
| 1,168,335 | 1/1916 | Rowntree | 105/3 |
| 1,298,194 | 3/1919 | Frick et al. | 105/3 |
| 2,101,793 | 12/1937 | Field | 105/3 |
| 2,114,720 | 4/1938 | McKeige | 105/3 |

FOREIGN PATENT DOCUMENTS

| | | | |
|---|---|---|---|
| 2673412 | 9/1992 | France | 105/3 |
| 526960 | 5/1931 | Germany | 105/3 |
| 528157 | 6/1931 | Germany | 105/3 |
| 79432 | 7/1931 | Germany | 105/3 |
| 682899 | 12/1993 | Switzerland | 105/3 |
| 2457 | of 1869 | United Kingdom | 105/3 |
| 362197 | 12/1931 | United Kingdom | 105/3 |

*Primary Examiner*—Mark T. Le
*Attorney, Agent, or Firm*—James Ray & Associates

[57] ABSTRACT

An improved end design for at least one predetermined end of a preselected railway type freight car which will enable such freight car to negotiate all of the track curvatures encountered in present day track structures while simultaneously enabling a plurality of such freight cars to be connected together to form a train consist in such a manner that will significantly reduce an overall length of such train consist. Such end design provides at least one predetermined end of such preselected railway type freight car having at least one of a convex shape and a double wedge shape.

7 Claims, 3 Drawing Sheets

END DESIGN FOR A RAILWAY TYPE FREIGHT CAR

FIELD OF THE INVENTION

The present invention relates, in general, to railway cars that are utilized in the railroad industry for transporting preselected freight which freight may include over the road type trailers, ocean going type cargo containers, chemicals, liquids, minerals, etc., and, more particularly, this invention relates to an improved design for the end of such freight cars which end design will enable the overall length of a train consist made up of these freight cars to be significantly reduced while at the same time retaining their necessary ability to negotiate all curves that will be encountered during their use on present day track structures.

BACKGROUND OF THE INVENTION

As is generally quite well known in the railroad industry, various types of standard coupling arrangements are used to connect the adjacently disposed ends of a pair of railroad cars together. Furthermore, on any of these railroad freight cars that will be used in interchange type service, these standard coupling arrangements must meet certain minimum standards and have received the approval of the Association of American Railroads (AAR) prior to their being installed on such adjacently disposed ends of the railway cars.

It is, also, generally well recognized, in the railroad industry, that such approved coupling arrangements will normally be required to serve a number of functions in this application. For example, standard couplers not only facilitate the connecting and disconnecting of individual railway freight cars to and from, respectively, a train consist but they also enable these individual railroad cars to more easily negotiate the curved portions of the track structure which will be encountered during operation of the train on such track structure. These standard coupling arrangements further permit such adjacently disposed ends of such railway cars to be easily separated into individual cars as may be necessary for either loading or unloading cargo thereto or therefrom, respectively.

Couplers are used to connect all types of railway freight cars on a train consist. The freight cars could be, for example, box cars, stock cars, gondola cars, hopper cars, tank cars, flat cars and/or piggyback type cars. But regardless of which type car is employed, and it can be any variety of those mentioned above along with the many variations of these types of cars as required to move the commodities and products of commerce in the United States, the cars must have a coupler on the ends of the car so that they may be connected to other cars.

Some railroad cars with special couplings, such as articulated couplers and slackless type drawbars, have their adjacently disposed ends connected together in a substantially semi-permanent arrangement.

Those units connected together by articulated coupler arrangements are commonly known in the railroad industry as "five-pack" or "ten-pack" units and are usually designed for dedicated service. These particular units will generally only be broken apart on a periodic basis or when necessary maintenance must be performed. However, it is important to note that the end cars of these packs be equipped with standard type couplers so that these units may be connected with other cars in order to form a train consist.

Regardless of the type of railroad car that is encountered or the type of coupling that is employed on these cars, the distance that must be maintained between the individual cars is governed by the distance needed to guarantee that the outer edges of the adjacently disposed ends of these cars do not come in contact with each other when the train consist is negotiating a curved portion of the track structure.

To the best of applicants knowledge, all of the railroad freight type cars presently in service have one thing in common and that is that the ends of the railroad car are substantially square. In other words, the ends provide a flat surface. Regardless of whether it is a box car, a piggyback car with its variety of configurations, or a tank car (which appears rounded but is mounted on a flat car with flat ends), all of these cars have square or flat surfaces on the ends.

Thus the length of the coupler shank (or the distance between cars) is set to the distance required to permit these cars to negotiate the most severe curve to be encountered on the track structure without coming into contact with the adjacent car. This distance is governed by two flat surfaces moving around an arc.

If the freight car ends were not flat but, for example, had a different configuration, even if this configuration were only on one end of one of the adjacently disposed cars, the distance between such cars could be reduced. The reduction of the distance between two adjacent cars does not sound meaningful, however, if this distance were multiplied by the number of cars in a train consist then this distance becomes very significant.

SUMMARY OF THE INVENTION

The present invention provides an improved design for at least one end of a railway type freight car which will generally enable such railway car to negotiate a greater degree of track curvature while simultaneously reducing the overall length of a train consist. This is achieved, according to the present invention, by permitting the adjacently disposed ends of a pair of such railway cars to be connected together in a much closer proximity to one another. This is accomplished, in one of the presently preferred embodiments of the invention, by providing a substantially arcuate or convex shaped end to a first railway car and a similar convex shaped end to an adjacently disposed end of a second railway car.

According to an alternative second embodiment of the present invention one end of a first railway car may be provided with a substantially convex shape while an adjacently disposed end of a second railway car does not require any modification. In other words, the adjacently disposed end of the second railway car is substantially square.

In another alternative third embodiment of the present invention one end of a first railway car may be provided with a substantially convex shape while an adjacently disposed end of a second railway car may be provided with a substantially concave shape.

According to still another alternative fourth embodiment of the present invention one end of a first railway car may be provided with a substantially double wedge shape and an adjacently disposed end of a second railway car does not require any modification. In this alternative embodiment, as discussed above, the adjacently disposed end of the second railway car can be substantially square.

In yet another alternative fifth embodiment of the present invention each of the adjacently disposed ends of a pair of railway freight cars are provided with a substantially double wedge shape.

OBJECTS OF THE INVENTION

It is, therefore, one of the primary objects of the present invention to provide an improved end design for at least one predetermined end of a preselected railway type freight car which will enable such freight car to negotiate all track curvatures encountered in present day track structures while simultaneously enabling a plurality of such freight cars to be connected together in order to form a train consist in such a manner that will significantly reduce the overall length of such train consist.

Another object of the present invention is to provide an improved end design for at least one predetermined end of a preselected railway type freight car which will enable such freight car to negotiate all track curvatures encountered in present day track structures while simultaneously enabling a plurality of such freight cars to be connected together in order to form a train consist in such a manner that will reduce the weight of the coupling arrangements required between such railroad cars.

Still another object of the present invention is to provide an improved end design for at least one predetermined end of a preselected railway type freight car which will reduce the weight of such freight car.

Yet another object of the present invention is to provide an improved end design for at least one predetermined end of a preselected railway type freight car which will reduce the fuel consumption due to a reduction in weight.

A further object of the present invention is to provide an improved end design for at least one predetermined end of a preselected railway type freight car which will enable such freight car to negotiate track curvatures of present track structures which is relatively simple in design.

An additional object of the present invention is to provide an improved end design for at least one predetermined end of a preselected railway type freight car which will enable such freight car to negotiate track curvatures of present track structures which is relatively inexpensive to manufacture.

Still a further object of the present invention is to provide an improved end design for at least one predetermined end of a preselected railway type freight car which will enable such freight car to negotiate track curvatures of present track structures which will not reduce the load carrying capacity of the car.

It is an additional object of the present invention to provide an improved end design for at least one predetermined end of a preselected railway type freight car which will enable such freight car to negotiate track curvatures of present track structures which is compatible with existing railway cars.

Still yet another object of the present invention to provide an improved end design for at least one predetermined end of a preselected railway type freight car which will enable such freight car to negotiate track curvatures of present track structures which will provide enhanced braking due to a shorter train length.

In addition to the several objects and advantages of the present invention which have been described above, various other objects and advantages of the present invention will become more readily apparent to those persons who are skilled in the relevant art from the more detailed description of the invention, particularly, when such description is taken in conjunction with the attached drawing Figures and with the appended claims.

Figure 1:
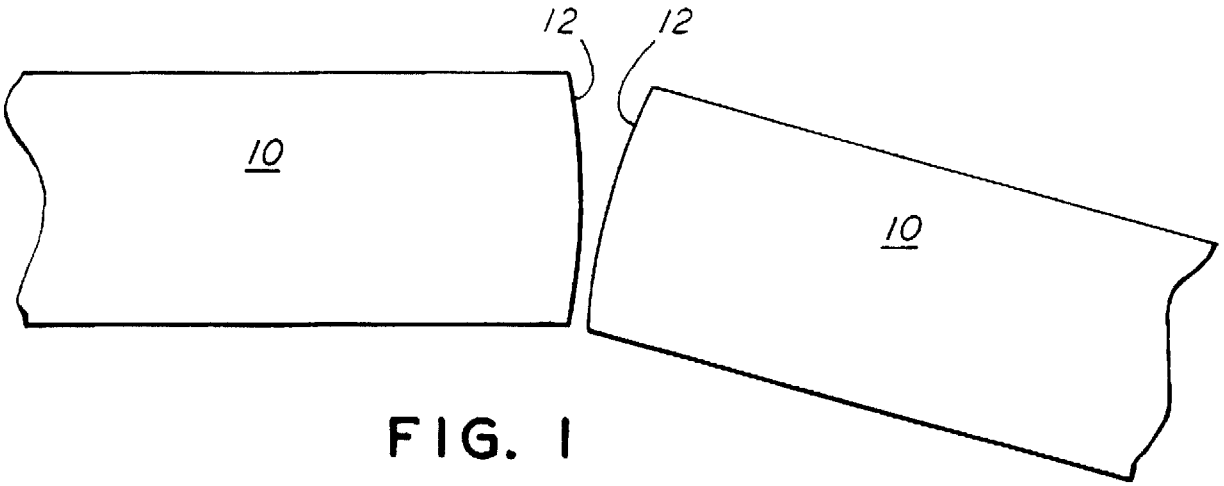
FIG. 1 is a plan view illustrating a car design wherein each of the adjacently disposed ends of a pair of adjacently disposed railway type freight cars are provided with a substantially convex shape.

DETAILED DESCRIPTION OF A PRESENTLY PREFERRED EMBODIMENT AND VARIOUS ALTERNATIVE EMBODIMENTS OF THE INVENTION

Prior to proceeding to the more detailed description of the present invention, it should be noted that for the sake of clarity and understanding of the invention, identical components which have identical functions have been identified with identical reference numerals throughout the several views that have been illustrated in the attached drawing Figures.

The present invention, as mentioned above, provides an improved end design for at least one predetermined end of a preselected railway type freight car which will enable such freight car to negotiate any of the track curvatures that will be encountered in present day track structures while simultaneously enabling a plurality of such freight cars to be connected together to form a train consist in such a manner that will significantly reduce the overall length of such train consist.

Reference is now made more particularly to FIG. 1. Illustrated therein is a presently preferred embodiment for an end design 12 for a railway type freight car, generally designated as 10. As shown, at least one predetermined end 12 of each one of the pair of adjacently disposed railway type freight cars 10 is provided with a substantially convex shape. It should be noted that the configuration illustrated would be the same regardless of the type of railroad freight car employed since the ends of all present day freight cars are substantially flat and the curvature of the convex shape according to the present invention would preferably be substantially the same whether such freight car were a box car, a flat car, a piggyback car and/or a tank car.

Figure 2:
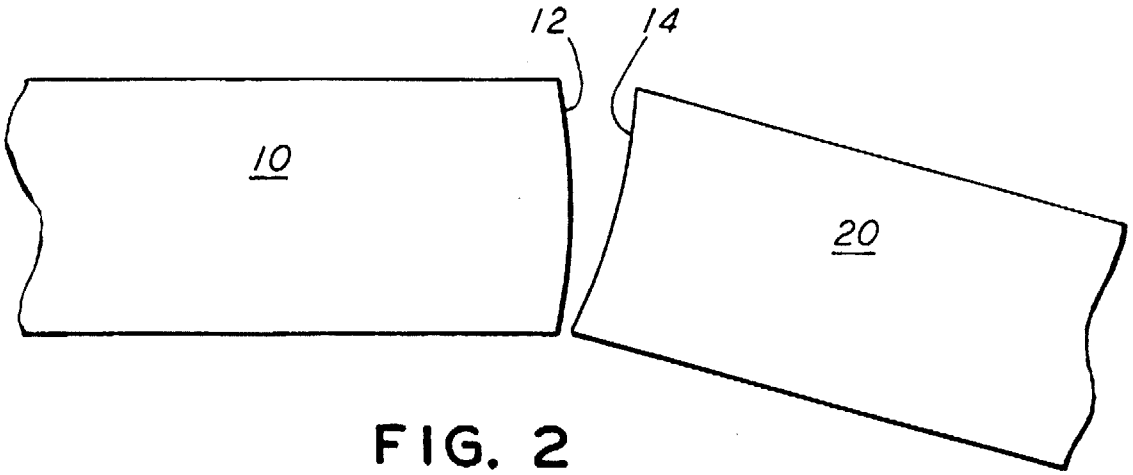
FIG. 2 is a plan view illustrating a car design wherein one end of a first railway type freight car has a substantially convex shape while an adjacently disposed end of a second railway type freight car has a substantially concave shape.

Reference is now made more particularly to FIG. 2. Illustrated therein is an alternative embodiment of the invention in which one predetermined end 12 of a first railway type freight car, generally designated 10, of a pair of adjacently disposed railway type freight cars has a substantially convex shape while an adjacently disposed end 14 of a second railway type freight car, generally designated 20, is provided with a substantially concave shape.

Figure 3:
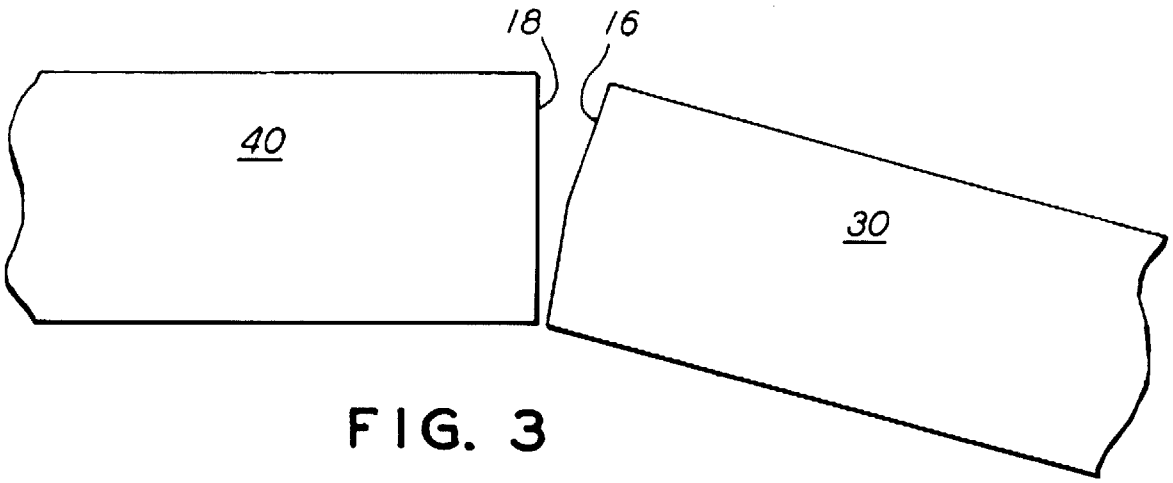
FIG. 3 is a plan view illustrating a car design wherein one end of a first railway type freight car has a double wedge shape while the adjacently disposed end of a second railway type freight car has a substantially square end and did not require any modification.

Reference is now made more particularly to FIG. 3. Illustrated therein is still another alternative embodiment of the invention in which one end 16 of a first railway type freight car, generally designated 30, of a pair of adjacently disposed railway type freight cars is provided with a substantially double wedge shape and an adjacently disposed end 18 of a second railway type freight car, generally designated 40, does not require any modification, i.e., such second railway type freight car 40 has a flat or square shape.

Figure 4:
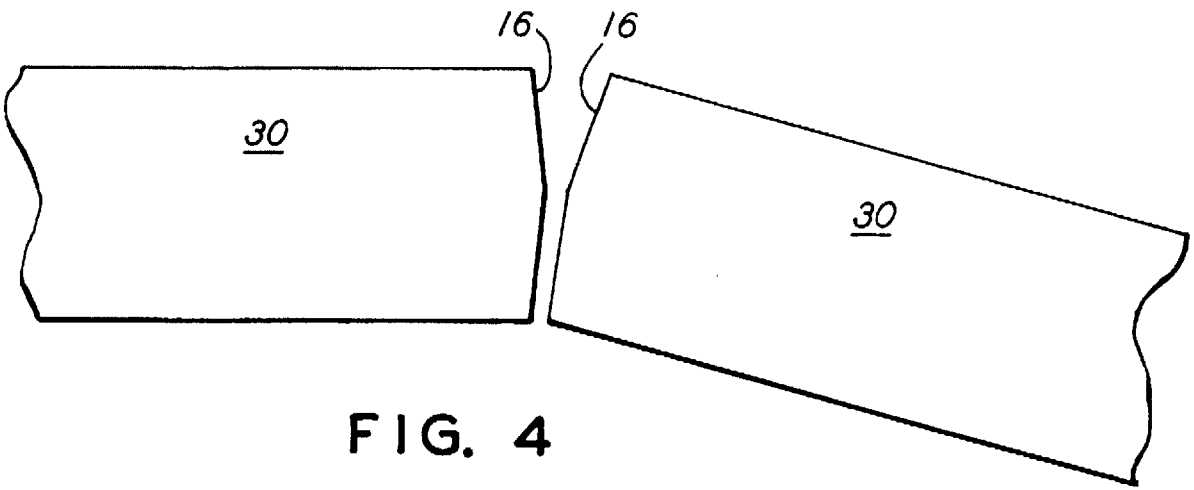
FIG. 4 is a plan view illustrating a car design wherein each adjacently disposed end of a pair of railway type freight cars is provided with a substantially double wedge shape.

Reference is now made more particularly to FIG. 4. Illustrated therein is yet another alternative embodiment of the invention in which each adjacently disposed end 16 of a pair of railway type freight cars, generally designated 30, is provided with a substantially double wedge shape.

Figure 5:
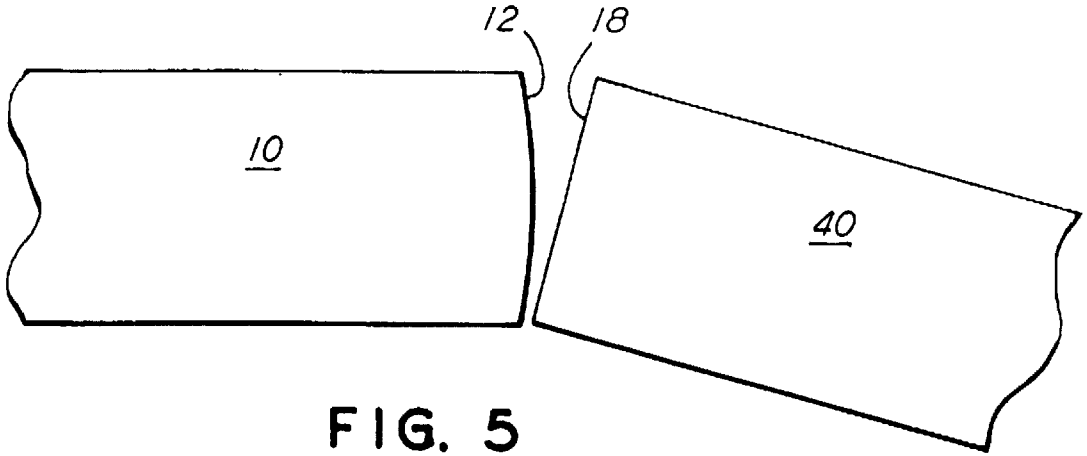
FIG. 5 is a plan view illustrating a car design wherein one end of a first railway type freight car has a substantially convex shape while the adjacently disposed end of a second railway type freight car has a substantially square end and did not require any modification.

Reference is now made more particularly to FIG. 5. Illustrated therein is a still further alternative embodiment of the present invention in which one end 12 of a first railway type freight car, generally designated 10, of a pair of adjacently disposed railway type freight cars is provided with a substantially convex shape and an adjacently disposed end 18 of a second railway type freight car, generally designated 40, does not require any modification, i.e., such second railway type freight car 40 has a flat or square shape.

Figure 6:
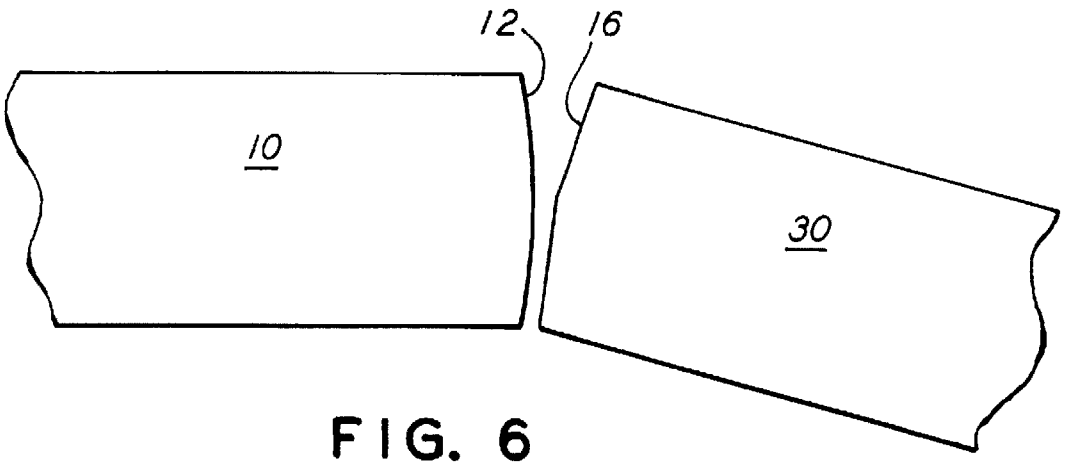
FIG. 6 is a plan view illustrating a car design wherein one end of a first railway type freight car has a substantially convex shape while an adjacently disposed end of a second railway type freight car has a substantially double wedge shape.

Finally, reference is made more particularly to FIG. 6. Illustrated therein is yet another alternative embodiment of the present invention in which one predetermined end 12 of a first railway type freight car, generally designated 10, of a pair of adjacently disposed railway type freight cars has a substantially convex shape while an adjacently disposed end 16 of a second railway car, generally designated 30, is provided with a substantially double wedge shape. As is further clearly shown in FIGS. 1, 2, 5 and 6, such freight cars are equipped with a handbrake mechanism mounted on a predetermined side of such railway freight car closely adjacent one end thereof.

While a presently preferred embodiment of the present invention and a number of alternative embodiments have been described in detail above, it should be understood that various other adaptations and/or modifications of the invention can be made by those persons who are particularly skilled in the relevant railroad freight car design art without departing from either the spirit of the invention or the scope of the appended claims.

We claim:

1. A railway car system comprising:

a plurality of railway freight cars connected to one another end-to-end to form a train consist, each of said railway freight cars having a handbrake mechanism mounted on a predetermined side of the railway freight car, closely adjacent to at least one end of the railway freight car; each of said railway freight cars including at least one end having one of a substantially convex shape, concave shape, and double wedge shape such that the length of the train consist and the distance between adjacent freight cars of said railway freight cars are reduced without interference between connected ends of said adjacent freight cars when the freight cars travel around track curves.

2. The railway car system of claim 1, wherein one end of each said freight cars has a substantially flat and square shape.

3. The railway car system of claim 1, wherein one end of each of said railway freight cars has said convex shape and the other end of each of said railway freight cars has said concave shape.

4. The railway car system of claim 1, wherein one end of each of said railway freight cars has said double wedge shape and the other end of each of said railway freight cars has a flat and square shape.

5. The railway car system of claim 1, wherein one end of each of said railway freight cars has said double wedge shape and the other end of each of said railway freight cars has said convex shape.

6. The railway car system of claim 1, wherein each end of each of said railway freight cars has said double wedge shape.

7. The railway car system of claim 1, wherein each end of each of said railway freight cars has said convex shape.

* * * * *